US007523922B2

(12) United States Patent
Shebuski

(10) Patent No.: US 7,523,922 B2
(45) Date of Patent: Apr. 28, 2009

(54) CARBURETOR FOR STRATIFIED CHARGE TWO-CYCLE ENGINE

(75) Inventor: David R. Shebuski, Franklin, TN (US)

(73) Assignee: Zama Japan Kabushiki Kaisha (JP)

( * ) Notice: Subject to any disclaimer, the term of this patent is extended or adjusted under 35 U.S.C. 154(b) by 0 days.

(21) Appl. No.: 11/687,199

(22) Filed: Mar. 16, 2007

(65) Prior Publication Data

US 2008/0224335 A1 Sep. 18, 2008

(51) Int. Cl.
*F02M 7/24* (2006.01)

(52) U.S. Cl. ..... 261/23.3; 123/73 PP; 261/52; 261/63; 261/DIG. 1

(58) Field of Classification Search ..... 261/23.3, 261/45, 52, 54, 63, DIG. 1; 123/73 PP
See application file for complete search history.

(56) References Cited

U.S. PATENT DOCUMENTS 3,677,241 A * 7/1972 Gele et al. ..... 123/327
3,957,929 A * 5/1976 Gural et al. ..... 261/34.2
4,002,704 A * 1/1977 Laprade et al. ..... 261/23.2
4,060,062 A * 11/1977 Tsutsui et al. ..... 261/23.3
6,101,991 A 8/2000 Glover
7,011,298 B2 * 3/2006 Gerhardy et al. ..... 261/46
7,090,204 B2 8/2006 Zwimpfer et al.
2004/0051186 A1 * 3/2004 Gerhardy et al. ..... 261/43
2006/0131763 A1 6/2006 Raffenberg
2006/0163755 A1 * 7/2006 Prager ..... 261/46

* cited by examiner

*Primary Examiner*—Richard L Chiesa
(74) *Attorney, Agent, or Firm*—Orrick, Herrington & Sutcliffe LLP

(57) ABSTRACT

A carburetor for a stratified charge two cycle engine with a choke bore, venturi, and throttle bore configuration matching an irregularly shaped choke valve. The trailing and leading edges of the choke and throttle valves, respectively, preferably overlap during wide open throttle operation to separate a single intake passage bore into an air intake passage above the choke and throttle valves and an air/fuel intake passage below the choke and throttle valves. The choke valve is preferably bent to minimize operational rotation and limit fuel spit back.

18 Claims, 3 Drawing Sheets

CARBURETOR FOR STRATIFIED CHARGE TWO-CYCLE ENGINE

FIELD OF THE INVENTION

The present invention relates to a carburetor for a stratified charge two-stroke engine.

BACKGROUND OF THE INVENTION

In accommodating a stratified charge two-cycle engine, different approaches carburetor design have been taken to separate an air-fuel mixture intake from an air intake. In U.S. Pat. No. 7,090,204, a plastic separator plate is inserted into the venturi of a single bore carburetor. The plate is intended to facilitate the separation of the air-fuel mixture staying on one side of the throttle valve and air only on the other side during wide-open throttle operation of a stratified charge two stroke engine. In U.S. Pat. No. 6,101,991, the bore of a single bore carburetor is divided into separate passages.

It is desirable to provide systems and methods that facilitate the separation of the air-fuel mixture intake from the air intake for operation of a stratified charge two stroke engine without the need for a separate separator plate or complex die casting to cast a fixed separator to split the bore in a carburetor body.

SUMMARY OF THE INVENTION

The embodiments described herein provide systems and methods that facilitate the separation of the air-fuel mixture intake from the air intake for operation of a stratified charge two stroke engine while eliminating the need for a separate separator plate or complex die casting to cast a fixed separator to split the bore in a carburetor body. In a preferred embodiment, the carburetor preferably utilizes a specially or irregularly shaped choke valve and matching choke bore and venturi configuration to enable separation of the air-fuel and air intake of a intake passage during wide open throttle operation. In addition, the trailing edge of the choke valve and leading edge of the throttle valve overlap one another in the venturi of the intake passage during wide open throttle operation creating an air intake passage above and an air-fuel intake passage below the throttle and choke valves. The shape or profile of the throttle bore, venturi and choke bore, which preferably matches the unique or irregular shape or profile of the choke valve, tends to minimize leakage between the two passages.

Further, objects and advantages of the invention will become apparent from the following detailed description.

DETAILED DESCRIPTION OF THE PREFERRED EMBODIMENTS

Figure 1:
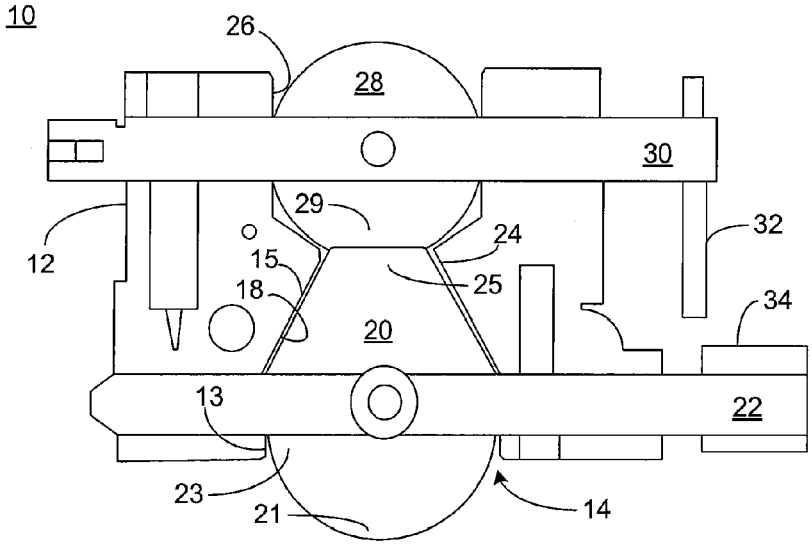
FIG. 1 is a top sectional view of a carburetor of the present invention with the choke and throttle valves in open position during wide-open throttle operation.
Figure 2:
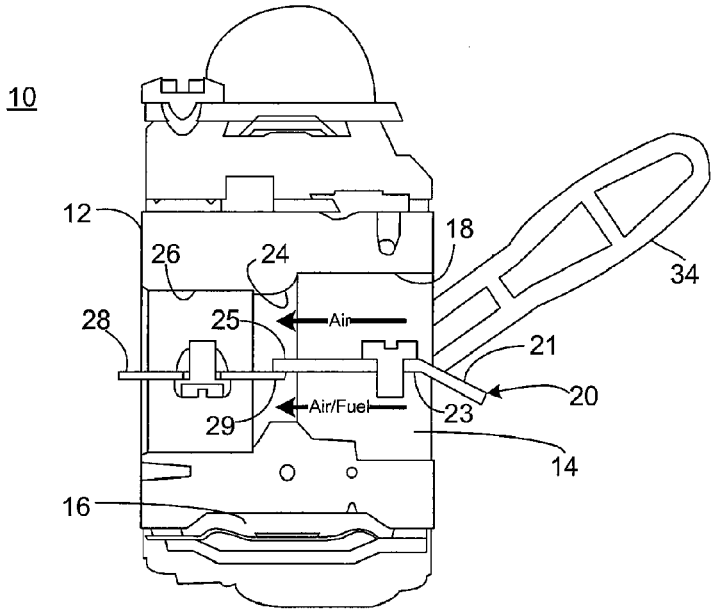
FIG. 2 is a side sectional view of the carburetor of the present invention with the choke and throttle valves in open position during wide-open throttle operation.

Embodiments are described below with reference to the drawings. FIGS. 1 and 2 are top and side sectional views, respectively, of a carburetor 10 comprising a body 12. The carburetor body 12 has an intake passage 14 extending (laterally from right to left in FIG. 2) through the body 12 for feeding an air/fuel mixture and air to an engine (not shown). A diaphragm type constant fuel chamber 16 is formed on the lower face of the body 12. The intake passage 14 has, in order from the inlet, or choke side, to the outlet, a choke bore 18, a choke valve 20 positioned within the choke bore 18 and coupled to a choke shaft 22 rotatably mounted in the body 12, a venturi 24 extending from the choke bore 18, a throttle bore 26 extending from the venturi 24, and a throttle valve 28 positioned with the throttle bore 24 and coupled to a throttle shaft 30 rotatably mounted in the body 12. A choke valve lever 32 and a throttle valve lever 34 are fixedly mounted to the ends of the choke valve shaft 22 and throttle valve shaft 30 protruding from the body 12.

The carburetor 10 preferably utilizes a specially or irregularly shaped, or non-uniform diameter, butterfly type choke valve 20 and matching choke bore 18 and venturi 24 configuration that enables the separation of the intake passage bore 14 of the carburetor body 12 into separate air-fuel intake and air intake passages during wide open throttle operation without requiring the use of any separator plates or castings as provided in conventional carburetor systems. As depicted in FIGS. 1 and 2, the trailing edge of the choke valve 20 and leading edge of the throttle valve 28 preferably overlap one another in the venturi 24 region during wide open throttle operation creating an air intake passage above the throttle 28 and choke 20 valves and an air-fuel intake passage below the throttle 28 and choke 20 valves. The shape or profile of the throttle bore 26, venture 24 and choke bore 18, which preferably matches the unique or irregular shape or profile of the choke valve 20, tends to minimize leakage between the two passages.

As depicted in FIGS. 1 and 2, a leading section or third 21 of the choke valve 20 positioned near and protruding from the inlet of the intake passage 14 is preferably circularly or semi-circularly shaped like a typical butterfly valve. A mid-section or middle third 23 of the choke valve 20 preferably has a constant diameter or has the shape of a rectangle. Alternatively, the leading 21 and middle 23 sections of the choke valve 20 combined may be circularly or semi-circularly shaped like a typical butterfly valve. A trailing section or third 25 of the choke valve 20 preferably has the shape of a truncated triangle.

The profile of the choke bore 18, venturi 24 and throttle bore 26, as shown in FIG. 1 in a plane parallel to the direction of air and air/fuel flow, preferably matches the unique or irregular shape or profile of the choke valve 20. Adjacent the inlet of the intake passage 14, the choke bore 18 has a constant bore or diameter section 13 matching the mid-section 23 of the choke valve 20. The choke bore 18 and venturi 24 then taper inwardly at a tapered section 15 in the direction of the outlet of the intake passage 14 matching the tapering of the truncated triangular shaped trailing section 25 of the choke valve 20.

Figure 5:
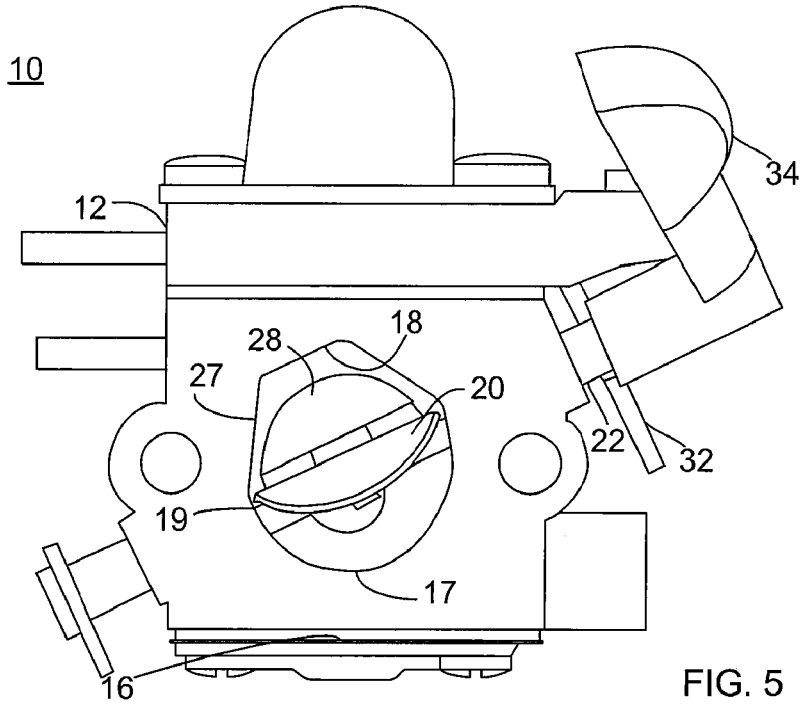
FIG. 5 is a side view of the carburetor from choke side of carburetor showing the choke valve in an open position.
Figure 6:
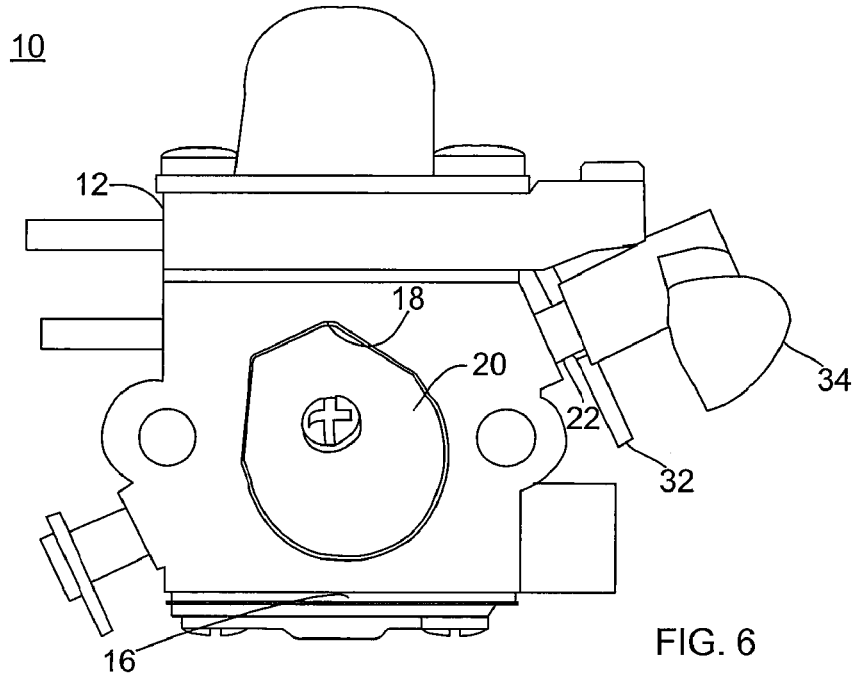
FIG. 6 is a side view of the carburetor from choke side of carburetor showing the choke valve in a closed position.

As depicted in FIGS. 5 and 6, the profile of the choke bore 18, viewed from the choke side of the carburetor 10 is similarly shaped to match the profile of the choke valve 20. The lower region 17 of the choke bore 18 profile or the region below the choke valve shaft 22, is preferably semi-circularly shaped to match the profile of the leading edge 21 of the choke valve 20, while the middle region 19 of the profile is preferably a constant diameter or rectangularly shaped to match the profile of the mid-section of the choke valve 20. The upper region 27 of the choke bore 18 profile or the region above the choke valve shaft 22, is preferably tapers inwardly or is in the shape of a truncated triangle with tapering side walls to match the profile of the trailing region 25 of the choke valve 20.

Figure 3:
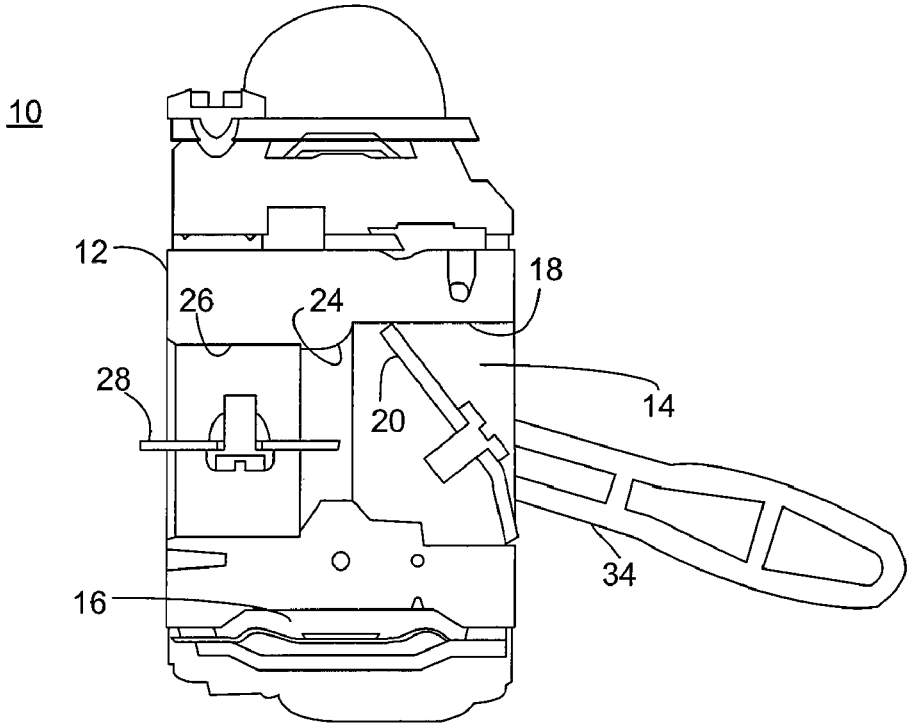
FIG. 3 is a side sectional view of the carburetor of the present invention with the throttle valve in open position and choke valve in closed position during starting.

As the side profile of the choke valve 20 depicted in FIG. 2 reveals, the leading section 21 of the choke valve 20 is preferably bent or angled downwardly from the plane parallel to the direction of air and air/fuel flow or, as depicted in FIG. 3, inwardly toward a closed position or toward the carburetor body 12. The bent profile of the choke valve 20 reduces the amount of rotation necessary to operate the choke valve 20 advantageously in a limited amount of space. The bend in the profile of the choke valve 20 also advantageously tends to reduce spit back of fuel in the choke bore 18 and air box (not shown) of the carburetor 10, which tends to limit the potential for short circuiting due to spit back fuel entering the air side passage.

Figure 4:
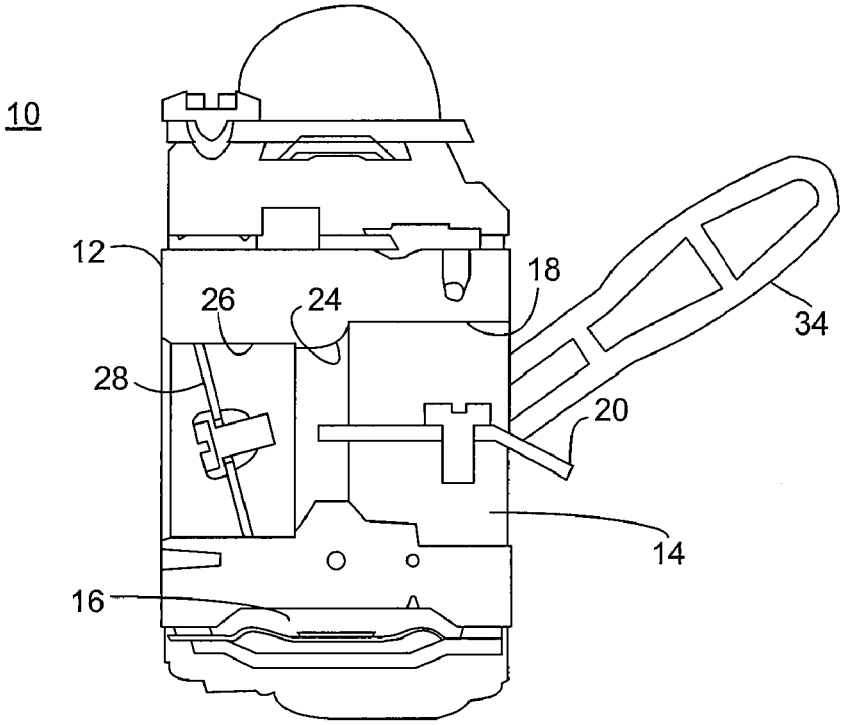
FIG. 4 is a side sectional view of the carburetor of the present invention with the choke valve in open position and throttle valve in closed position during idle operation.

FIGS. 1 through 4 show three modes of operation—wide-open-throttle, start and idle. As shown in FIGS. 1 and 2, during wide-open-throttle operation, both the choke valve 20 and throttle valve 28 are fully open with their trailing 25 and leading 29 edges, respectively, over lapping to form an air intake passage above the choke valve 20 and throttle valve 28 and separate from an air/fuel intake passage below the choke valve 20 and throttle valve 28. In the start position, as depicted in FIG. 3, the throttle valve 28 remains open while the choke valve 20 is rotated approximately fifty degrees (50°) to a closed position where the leading edge 21 of the choke valve 20 contacts the lower wall of the choke bore 18 adjacent the inlet of the intake passage 14 (see also FIG. 6) and the trailing edge of the choke valve 20 contacts the upper wall of the choke bore 18 adjacent the venturi 24. At idle, as depicted in FIG. 4, the choke valve 20 remains open as the throttle valve 28 is rotated to a closed position.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A carburetor for a stratified charge two cycle engine comprising a body, an intake passage extending through the body and comprising a choke bore, a venturi, and a throttle bore, a choke valve positioned within the choke bore and having a non-uniform diameter profile, wherein the choke bore having an inlet profile and a profile in a plane parallel to an intake flow direction that are shaped to substantially match the choke valve profile, wherein a leading section of the choke valve adjacent an inlet of the intake passage is semi-circularly shaped, wherein a trailing section of the choke valve has a truncated triangle shape, and a throttle valve positioned within the throttle bore and having a leading edge that overlaps with a trailing edge of the choke valve at wide-open-throttle operation to separate the intake passage into an air intake passage above the choke and throttle valves and an air/fuel intake passage below the choke and throttle valves.

2. The carburetor of claim 1 wherein the choke valve is bent inwardly toward the body in a region of the choke valve adjacent a leading edge of the choke valve.

3. The carburetor of claim 1 further comprising a diaphragm constant fuel chamber formed on a face of the body.

4. The carburetor of claim 1 further comprising a choke shaft rotatably mounted in the body, the choke valve being coupled to the choke shaft.

5. The carburetor of claim 1 further comprising a throttle shaft rotatably mounted in the body, the throttle valve being coupled to the throttle shaft.

6. The carburetor claim 1 wherein the choke valve is shaped to reduce the amount of rotation necessary to transition between choke valve position for wide-open-throttle operation and starting.

7. The carburetor of claim 1 wherein a mid-section of the choke valve has a constant diameter.

8. The carburetor of claim 1 wherein a mid-section of the choke valve is rectangularly shaped.

9. A carburetor for a stratified charge two cycle engine comprising a body, an intake passage extending through the body and comprising a choke bore, a venturi, and a throttle bore, a choke valve positioned within the choke bore and having a non-uniform diameter profile, wherein the choke bore having an inlet profile and a profile in a plane parallel to an intake flow direction that are shaped to substantially match the choke valve profile, wherein the profile of the choke bore in a plane parallel to the direction of the intake flow has a constant diameter section adjacent an inlet of the intake passage, wherein the profile of the choke bore in a plane parallel to the direction of the intake flow has a tapered section following the constant diameter section that tapers inwardly in the direction of the intake flow, and a throttle valve positioned within the throttle bore and having a leading edge that overlaps with a trailing edge of the choke valve at wide-open-throttle operation to separate the intake passage into an air intake passage above the choke and throttle valves and an air/fuel intake passage below the choke and throttle valves.

10. The carburetor of claim 9 wherein a leading section of the choke valve adjacent an inlet of the intake passage is semi-circularly shaped.

11. The carburetor of claim 10 wherein a mid-section of the choke valve has a constant diameter.

12. The carburetor of claim 10 wherein a mid-section of the choke valve is rectangularly shaped.

13. The carburetor of claim 9 wherein the choke valve is shaped to reduce the amount of rotation necessary to transition between choke valve position for wide-open-throttle operation and starting.

14. The carburetor of claim 9 wherein the choke valve is bent inwardly toward the body in a region of the choke valve adjacent a leading edge of the choke valve.

15. The carburetor of claim 1 further comprising a diaphragm constant fuel chamber formed on a face of the body.

16. The carburetor of claim 9 further comprising a choke shaft rotatably mounted in the body, the choke valve being coupled to the choke shaft.

17. The carburetor of claim 9 further comprising a throttle shaft rotatably mounted in the body, the throttle valve being coupled to the throttle shaft.

18. A carburetor for a stratified charge two cycle engine comprising a body, an intake passage extending through the body and comprising a choke bore, a venturi, and a throttle bore, a choke valve positioned within the choke bore and having a non-uniform diameter profile, wherein the choke bore having an inlet profile and a profile in a plane parallel to an intake flow direction that are shaped to substantially match the choke valve profile, wherein the profile of the choke bore in a plane parallel to the direction of the intake flow has a constant diameter section adjacent an inlet of the intake passage, wherein the profile of the choke bore in a plane parallel to the direction of the intake flow has a tapered section following the constant diameter section that tapers inwardly in the direction of the intake flow, wherein the tapered section has a truncated triangular shape, and a throttle valve positioned within the throttle bore and having a leading edge that overlaps with a trailing edge of the choke valve at wide-open-throttle operation to separate the intake passage into an air intake passage above the choke and throttle valves and an air/fuel intake passage below the choke and throttle valves.

* * * * *